United States Patent [19]

Khan

[11] Patent Number: 4,747,938

[45] Date of Patent: May 31, 1988

[54] LOW TEMPERATURE PYROLYSIS OF COAL OR OIL SHALE IN THE PRESENCE OF CALCIUM COMPOUNDS

[75] Inventor: M. Rashid Khan, Morgantown, W. Va.

[73] Assignee: The United States of America as represented by the United States Department of Energy, Washington, D.C.

[21] Appl. No.: 853,117

[22] Filed: Apr. 17, 1986

[51] Int. Cl.[4] ..... C10G 1/04

[52] U.S. Cl. ..... 208/419; 208/420; 208/428; 208/430; 208/435; 208/127

[58] Field of Search ..... 208/419, 420, 428, 435, 208/430, 127

[56] References Cited

U.S. PATENT DOCUMENTS

| | | | |
|---|---|---|---|
| 3,715,303 | 2/1973 | Wennerberg et al. | 208/419 |
| 4,054,492 | 10/1977 | Rammler et al. | 208/430 |
| 4,060,478 | 11/1977 | Lang | 208/435 |
| 4,305,809 | 12/1981 | Chen et al. | 208/127 |
| 4,414,099 | 11/1983 | Schucker | 208/127 |
| 4,439,304 | 3/1984 | Sudbury et al. | 208/419 |
| 4,479,804 | 10/1984 | Chen et al. | 208/127 |
| 4,521,382 | 6/1985 | Kessick et al. | 208/127 |
| 4,521,383 | 6/1985 | Kessick et al. | 208/127 |

OTHER PUBLICATIONS

Chemical Abstract 100:123929a, (1984).
Chemical Abstract 103:163097w, (1985).
Chemical Abstract 105:155918r, (1986).
Chemical Abstract 106:7295r, (1987).
"Fundamentals of Coal Combustion", by R. H. Essenhigh, Chemistry of Coal Utilization 2nd Sup vol., John Wiley, (1981), pp. 1153, 1155, 1156, 1160, 1162, 1163.
"Influence of Added Calcium Compounds or Swelling, Plastic Pyrolysis Behavior of Coal Devolatilized at Elevated Pressures", by M. Rashid Khan & Robert G. Jenkins, Fuel, vol. 65, Sep. 1986.
"Production of a High-Quality Liquid Fuel from Coal by Mild Pyrolysis of Coal-Lime Mixtures", DOE/-METC-86/400, Mar. 1986, Entire Technical Note.

*Primary Examiner*—Asok Pal
*Attorney, Agent, or Firm*—Earl L. Larcher; Stephen D. Hamel; Judson R. Hightower

[57] ABSTRACT

A coal pyrolysis technique or process is described in which particulate coal is pyrolyzed in the presence of about 5 to 21 wt. % of a calcium compound selected from calcium oxide, calcined (hydrate) dolomite, or calcined calcium hydrate to produce a high quality hydrocarbon liquid and a combustible product gas which are characterized by low sulfur content. The pyrolysis is achieved by heating the coal-calcium compound mixture at a relatively slow rate at a temperature of about 450° to 700° C. over a duration of about 10 to 60 minutes in a fixed or moving bed reactor. The gas exhibits an increased yield in hydrogen and $C_1$–$C_8$ hydrocarbons and a reduction in $H_2S$ over gas obtainable by pyrolyzing cola without the calcium compound. The liquid product obtained is of a sufficient quality to permit its use directly as a fuel and has a reduced sulfur and oxygen content which inhibits polymerization during storage.

4 Claims, No Drawings

LOW TEMPERATURE PYROLYSIS OF COAL OR OIL SHALE IN THE PRESENCE OF CALCIUM COMPOUNDS

BACKGROUND OF THE INVENTION

The present invention relates generally to the gasification of carbonaceous materials by pyrolysis for the production of hydrocarbon liquids and combustible gases, and more particularly to the preparation of high quality liquid hydrocarbon and combustible gas products by the pyrolysis of coal or oil shale at relatively low temperatures in the presence of calcium compounds.

Coal and oil shale have been subjected to various thermal decomposition procedures for providing combustible product gases and hydrocarbon liquids which can be used as fuels or as fuel precursors. For example, coal has been gasified and liquified by externally applied heat or pyrolysis of coal constituents.

Of the several techniques utilized to produce liquids from coal some of the better known include such processes as the direct liquefaction by hydrogenation, indirect liquefaction by Fischer-Tropsch processes, and pyrolysis by employing high heating rates such as hydropyrolysis. These processes are relatively complex and expensive to operate so as to provide a relatively high-cost product as compared to other sources of hydrocarbon liquids derived from petroleum. Thus, the direct and indirect coal liquefaction procedures that provide acceptable liquid hydrocarbon products which can be used directly as fuels or which can be further refined to provide more acceptable fuel products are presently considered to be excessively costly procedures so as to detract from their utilization at the present time. Pyrolysis processes using rapid heating techniques have been found to increase the yield of product liquids but the resulting liquids are of relatively poor quality due to the low hydrogen to carbon ratios (H/C) and high sulfur content which necessitates costly upgrading.

SUMMARY OF THE INVENTION

The present invention relates to a modified coal or oil shale pyrolysis process which is capable of producing a high quality liquid hydrocarbon which can be used in its present form as a fuel or a fuel additive and which can be readily upgraded by refining the oil. The process also provides combustible gases which are of sufficient quality for use as pipeline gases in various combustion systems. The process is achieved by manipulating the chemistry of secondary reactions of the primary pyrolysis products by pyrolyzing coal or oil shale in the presence of calcium compounds selected from calcium oxide, calcined calcium hydroxide, or calcined dolomite (hydrate) at a relatively low temperature over a relatively extensive duration as compared to prior art procedures. The process is particularly suitable for coal and is practiced in relatively low cost fixed or moving bed-type reactors where pyrolysis of the coal with lime or other calcium compounds occurs to produce the hydrocarbon rich liquids and gases from the hydrocarbon rich portion of the coal before the char produced as a byproduct of the reaction is subjected to combustion processes. When the coal is pyrolyzed at a relatively slow rate in the presence of the calcium compound the yield of the hydrocarbon liquid is not increased by any significant extent over that of prior art procedures but the quality, for example, the hydrogen-to-carbon ratio, of the liquid is greater than that obtainable by pyrolysis at a relatively high heating rate as utilized in presently known gasification procedures. Also, as a byproduct the chars produced by the reaction contain an appreciable quantity of volatile matter so as to be useful as fuels in various combustion processes.

In practicing the gasification method of the present invention for the production of hydrocarbon liquids and combustible gases the steps utilized comprise heating a particulate mixture consisting essentially of a carbonaceous material selected from coal or oil shale and about 5–21 wt. % of a calcium compound as described above to a pyrolysis temperature in the range of about 450° to 700° C., maintaining the mixture at a temperature within this range for a duration of about 10 to 60 minutes, and removing liquid and gaseous products as they are generated during the pyrolysis of the carbonaceous material. The carbonaceous material-calcium compound mixture is heated to the pyrolysis temperature at a rate of about 5° to 50° per minute so as to provide the desired low temperature heating rate. The preferred size of the coal or oil shale particulates used in the process are in the range of about 8 to 100 mesh while the calcium compound particulates are in the range of about 325 to 0 mesh. Carbonaceous material of a size less than 100 mesh are also satisfactorily used in the present invention as will be described below.

By practicing the method of the present invention with coal the product liquid is provided with about 40% less sulfur than the same coal pyrolyzed without calcium oxide. It has been found that pyrolysis of coal with CaO reduces organic sulfur content of the liquids. It is believed this reduction in sulfur content is apparently due to the formation of CaS in the presence of CaO which renders sulfur species unavailable to participate in the free radical chemistry so that less sulfur is incorporated into the organic matrix. The oxygen content of the liquid product is also reduced over that provided by previously known processes, which is considered desirable in that gasification produced liquids, e.g., tars, with a high oxygen content tend to be unstable and subjected to relatively rapid plymerization to restorage procedures. Further, the depletion of oxygen in the liquid reduces the mutagenic and carsinogenic properties within the product liquid. The gases produced by the process have less hydrogen sulfide $H_2S$ and $CO_2$ content than obtainable by using the high rate previously practiced gasification processes and a greater concentration of the $C_1$–$C_8$ hydrocarbons than obtainable without the concentration of calcium oxide and the use of the low heating rate.

Further objects of the invention will be obvious upon an understanding of the illustrative method about to be described or will be indicated in the appended claims, and various advantages not referred to herein will occur to one skilled in the art upon employment of the invention in practice.

DETAILED DESCRIPTION OF THE INVENTION

As briefly described above the present invention is directed to a process for the pyrolysis of coal or oil shale in the presence of a calcium compound selected from calcium oxide, calcined hydrated dolomite or calcined calcium hydroxide at a relatively low or slow heating rate over a relatively long duration as compared to the prior art processes for effectively manipulating the secondary reactions of the primary combustion products generated by the pyrolysis of the coal to produce a quality of product gases and hydrocarbon liquids not heretofore obtainable by pyrolysis techniques.

While the following description is directed primarily to the low temperature pyrolysis of coal, it is to be understood that oil shale can be similarly pyrolyzed in the presence of the aforementioned calcium compounds to produce high-quality, low-sulfur, product gases and hydrocarbon liquids such as described in Table V.

The pyrolysis of the coal is achieved in a conventional low-cost reactor of a fixed bed type in which the coal is pyrolyzed in a stacked concentrated bed within the reactor. Alternatively, a moving bed-type reactor where the coal-calcium compound mixture in a concentrated pile is slowly moved through a furnace can be utilized for effecting the pyrolysis of the coal in accordance with the present invention. To effect the pyrolysis of the coal in such reactors the coal is initially ground to a size range between 8 and 100 mesh but can be less than about 100 mesh for effecting the efficient pyrolysis of the coal.

The calcium compounds found to be useful in the present invention are calcium oxide, lime, dolomite, and calcium hydroxide. The calcium compounds are calcined in any satisfactory manner. It has been found that the freshly calcined material apparently provides greater surface active and is preferred over calcium compounds that have had a relatively long shelf life after calcination. Also, the dolomite is hydrated to provide better activity. The preferred size of the calcium compound particulates is less than about 325 mesh and in a concentration of about 5–25 wt. % of the coal-calcium compound mixture. Preferably, the concentration of the calcium compound is in the range of about 5 to 21 wt. %. With the calcium compound at a concentration less than about 5 wt. % there is insufficient calcium compound to capture sulfur compounds. With more than about 25 wt. % of the calcium compound significant cracking/polymerization of liquids may occur leading to a lower liquid yield. The particulates of the coal and the selected calcium compound are blended together prior to introduction into the furnace by using any suitable blending technique.

With the coal-calcium compound mixture introduced into the reactor the temperature of the reactor is increased to the desired heating temperature at a rate of about 5° to 50° per minute with the pyrolysis temperature being in the range of about 450° to 700° C. and preferably about 500° to 600° C.

The gases produced by the pyrolysis of the coal in accordance with the present invention are almost sulfur-free and have a considerable increase in the concentration of the $C_1$–$C_8$ hydrocarbons so as to provide pipeline quality gas having a relatively high heating rate. The liquids produced, as pointed out above, have a reduced sulfur and oxygen content but also have a heating value slightly greater than that obtainable without the use of the calcium compound. In addition, the phenolic aromatic constituents are markedly reduced and the hydrogen-to-carbon ratios, which are in the range between about 1.3–1.5, are of a better quality than those obtainable by practicing several so-called advanced rapid heating pyrolysis techniques. It is believed that the relatively long residence time during the pyrolysis as provided by the slow heating rate and the packed bed of the coal-calcium compound mixture provides for greater contact between the coal and the calcium compound to occur during pyrolysis with the calcium compound acting as a catalyst for producing high quality fuel. Inasmuch as the calcium compound promotes an increase in the hydrogen evolution between temperatures of about 500° to 900° C. the calcium compound serves as a dehydrogenation catalyst which is reflected by a reduction in the thermoplastic nature of the coal.

In order to provide a most facile understanding of the present invention examples relating to typical procedures employing the pyrolysis process of the present invention a Fischer assay-type reactor is utilized to demonstrate the operation of the present invention. A Fischer assay-type batch reactor with a capacity of about 250 milliliters was modified to collect the product liquid and gases and to introduce gas flow, if necessary, into the bottom of the reactor through a distributor for reactor purging purposes. The Fischer assay unit used in these examples is believed to clearly demonstrate that any conventional fixed or moving bed-type reactor capable of providing a time-temperature history similar to that of the reactor used in the examples can be utilized to obtain results described herein on a commercial scale.

EXAMPLE I

The batch-type reactor was loaded with 100 grams of coal in a particle in the size range of −8 by +100 mesh and then heated to 500° C. in 40 minutes and thereafter maintained at 500° C. for a period of one hour. Several runs were made using high volatile bituminous coals, namely, Pittsburgh No. 8 and Illinois No. 6, in the reactor and the results are shown of these runs in the first and fourth columns of Table I below. The product gases were collected during the runs using gas storage bags and analyzed promptly using gas chromatographs for indicating the presence of light hydrocarbons, CO, $CO_2$, COS and $H_2S$. The collected liquids were analyzed to show the presence of sulfur, liquid viscosity, oxygen content, heating value, hydrogen-to-carbon ratios, as well as Conradson carbon residue and densities. The results of this Example are listed in Table I below.

EXAMPLE II

In this Example a batch of 100 grams of Pittsburgh No. 8 coal similar in size to that used in Example I was mixed with calcium oxide particulates of a mesh size of about 400 to zero to provide a mixture with 10 wt. % calcium oxide. A similar coal-calcium oxide mixture was also prepared but with 21 wt. % calcium oxide. These mixtures were pyrolyzed as in Example I and the results shown in Table I below adjacent to the results provided by the runs in Example I. As indicated in Table I, the devolatilization of the coal at this slow heating rate in the presence of the calcium oxide significantly reduced the yield of $H_2S$ in the product gases. For example, for the Pittsburgh No. 8 coal the $H_2S$ yield in the product gas is reduced from 3.7 vol. % to 1.0 vol. % when the 10 wt. % calcium oxide was used and down to 0.1 vol. % when 21 wt. % of the calcium oxide (Ca:S=6:1) was used. With Illinois No. 6 coal the 21 wt. % calcium oxide concentration (Ca:S=3.75:1) reduced the $H_2S$ yield from 5.2 vol. % to 0.1 vol. %. The elemental analysis of the solid and liquid products show that the total sulfur in the product liquids was significantly reduced from 0.72 wt. % to 0.67 wt. % with 10 wt. % calcium oxide and to 0.64 wt. % with 21 wt. % calcium oxide for the Pittsburgh No. 8 coal and from 0.54 wt. % to 0.34 wt. % for the Illinois No. 6 coal with 21 wt. % calcium oxide. X-ray diffraction studies indicate that the calcium oxide reduces the hydrogen sulfide yield in the gases by forming CaS and water. The presence of calcium oxide during devolatilization also increases significantly the yield of hydrogen and the ($C_1$–$C_8$) hydrocarbon gases. Another effect of the calcium oxide addition is in the reduction of the carbon dioxide which is attributed to the formation of calcium carbonate by the reaction of calcium oxide and the carbon dioxide which is thermodynamically favorable at about 500° C.

TABLE I

| | Pittsburg No. 8 | | | Illinois No. 6 | |
|---|---|---|---|---|---|
| | 0 wt. % CaO | 10 wt. % CaO | 21 wt. % CaO | 0 wt. % CaO | 21 wt. % CaO |
| Total Gas (L) | 7.0 | 7.0 | 7.1 | 7.6 | 6.0 |
| Char (wt. %) | 75.3 | 75.5 | 76.2 | 76.7 | 77.8 |
| Tar (wt. %) | 17.7 | 17.5 | 16.5 | 15.0 | 14.0 |
| Gas (vol. %) | | | | | |
| $H_2$ | 11.6 | 12.2 | 13.4 | 12.35 | 13.5 |
| CO | 3.9 | 3.9 | 3.2 | 7.2 | 7.1 |
| $CO_2$ | 5.4 | 1.3 | 0.2 | 11.2 | 3.1 |
| $C_1$–$C_8$ | 75.4 | 81.5 | 83 | 62.7 | 76.0 |
| $H_2S$ | 3.7 | 1.0 | 0.1 | 5.2 | 0.1 |
| COS | 0.39 | 0.1 | 0.03 | 0.53 | 0.09 |
| $CH_4$ | 49.8 | — | 53.7 | 48.3 | 49 |
| Tar | | | | | |
| Total S (wt. %) | 0.72 | 0.67 | 0.64 | 0.54 | 0.35 |
| Heating Value (Btu/lb) | 15,926 | 15,986 | 16,581 | 14,980 | 15,905 |
| H/C (Atomic) | 1.35 | — | 1.31 | 1.42 | 1.32 |
| Viscosity in St at 100° F. | 51.5 | — | 29.7 | 37.0 | 18.75 |
| Conradson Carbon Residue | 6.07% | — | 5.22% | — | — |
| Pour Point, °F. | 50° | — | 45° | — | — |
| Density (g/cc) | 1.0299 | — | 1.0157 | — | — |
| Oxygen (By Difference wt. %) | 7.89 | 6.55 | 3.96 | 12.44 | 8.42 |
| Phenol ($C_6H_6O$) (wt. %) | 3.66 | — | 2.8 | — | — |
| Methyl Phenol ($C_7H_8O$) wt. % | 10.85 | — | 7.99 | — | — |
| Dimethyl Phenol ($C_8H_{10}O$) wt. % | 10.05 | — | 7.47 | — | — |

TABLE II

Effects of CaO Addition on Mild Pyrolysis Products Yield and Composition for Pittsburgh No. 8 Coal (Particle Size −100 Mesh)

| | ASTM Fischer Assay (100 g Coal) | ASTM Fischer Assay + CaO (100 g Coal + 21 g CaO) |
|---|---|---|
| Yield Gas (L) | 7.0 | 7.0 |
| Char (wt. %) | 75.4 | 77.3 |
| tar (wt. %) | 17.0 | 14.6 |
| Gas Composition (Vol. %) | | |
| $H_2$ | 11.3 | 12.7 |
| CO | 3.6 | 3.1 |
| $CO_2$ | 5.4 | 0.1 |
| $C_1$–$C_8$ | 76.2 | 84.0 |
| $H_2S$ | 3.2 | 0 |
| $CH_4$ | 49.2 | 55.7 |
| Tar | | |
| Total S (wt. %) | 0.71 | 0.51 |
| Heating Value (Btu/lb) | 16,243 | 16,607 |
| H/C (Atomic) | 1.33 | 1.27 |
| Oxygen (By Difference) | 9.14 | 5.49 |

EXAMPLE III

In another demonstration of the present invention a 100 gram batch of Pittsburgh No. 8 coal of a size less than 100 mesh was mixed with 21 grams of calcium oxide and subjected to the same pyrolysis conditions utilized in Example I. The results of the pyrolysis in this example are set forth in Table II and are compared with the pyrolysis of the Pittsburgh No. 8 coal of less than 100 mesh without the calcium oxide addition. As indicated, the use of the calcium oxide reduces the $H_2S$ content from 3.2 vol. % to 0 vol. %. The $CO_2$ is also reduced from about 5.4 vol. % to 0.1 vol. % while the hydrogen and $CH_4$ concentrations are increased. This data indicates that significant sulfur capture occurs when the calcium oxide is utilized with the smaller sized coal fractions. The greater reduction in $H_2S$ is believed to result from a better mixture of the coal and calcium oxide components and better contact between the calcium oxide and the devolatilized sulfur products during coal pyrolysis. This example demonstrates the usability of coal of less than about 100 mesh in a batch process. Presently, such coal fines are considered as "waste" as they have very limited applications.

The utilization of calcium oxide, calcined (hydrate) dolomite, or calcinced calcium hydroxide in the present invention is believed to be unique in that various other low-cost inorganic additives commonly used in coal gasification processes such as calcium carbonate ($CaCO_3$), ferric oxide ($Fe_2O_3$), magnesium oxide (MgO) and silicon oxide ($SiO_2$) have not proven to be particularly successful. As indicated in Table III, the use of these other inorganic additives did not provide the extent of sulfur reduction achievable by the use of calcium oxide except for the use of the 21 wt. % $Fe_2O_3$. While the $Fe_2O_3$ the $H_2S$ concentration other features such as increased $H_2$ and char yield were at the expense of reduced tar and yield of the $C_1$–$C_8$ hydrocarbons. The reduction of the $H_2S$ yield is accompanied by the reformation of FeS by the reaction of $Fe_2O_3$ with sulfur compounds. In Table III the most significant influence of the calcium carbonate at 35 wt. % concentration (with the calcium-to-sulfur ratio of about 6) is observed in the reduction of the hydrogen sulfide from about 3.7 vol. % to 2.3 vol. %. In addition, the changes in the overall yield of the evolved volatiles, namely, the hydrogen, carbon monoxide, carbon dioxide and the $C_1$–$C_8$ hydrocarbons were relatively small so as to indicate that the calcium carbonate is not a sufficiently satisfactory catalyst as the calcium oxide under the pyrolysis conditions utilized in the method of the present invention.

TABLE IV-continued

Influence of Added Calcined Hydrated Dolomite on Pyrolysis Products for Pittsburgh No. 8 Coal at 500° C.

| | Pittsburgh No. 8 Coal 500° C. | Pittsburgh No. 8 Coal with 5 wt. % | Pittsburgh No. 8 Coal with 10 wt. % |
|---|---|---|---|
| N | 1.59 | 1.56 | 1.34 |
| O | 7.89 | 7.66 | 6.6 |
| H/C (Atomic) | 1.35 | 1.32 | 1.31 |
| Btu/lb | 15,926 | 16,126 | 15,665 |
| Char Composition (Dry, Wt. %) | | | |
| C | 75.09 | 68.24 | 64.47 |
| H | 2.72 | 3.15 | 3.01 |
| N | 1.92 | 1.48 | 1.37 |
| S | 1.77 | 1.69 | 1.59 |
| Ash/Additive | 9.98 | 16.83 | 20.53 |
| VM | 13.51 | 13.1 | 13.3 |
| $H_2O$ | 1.0 | 0.9 | 0.70 |
| H/C | 0.435 | 0.554 | 0.56 |
| Btu/lb | 12,413.0 | — | — |

TABLE III

Effects of Various Inorganic Additives on Gaseous Product Yields of Pittsburgh No. (8 Coal −8 to +100 mesh)

| | 100 g Coal | 100 g Coal + 21 wt. % $Fe_2O_3$ | 100 g Coal + 21 wt. % $CaCO_3$ | 100 g Coal + 35 wt. % $CaCO_3$ | 100 g Coal + 21 wt. % MgO | 100 g Coal + 21 wt. % $SiO_2$ |
|---|---|---|---|---|---|---|
| Char (wt. %) | 75.3 | 78.2 | 75.4 | 76.6 | 75.2 | 75.5 |
| tar (wt. %) | 17.7 | 13.5 | 16.8 | 15.6 | 16.0 | 16.2 |
| Gas Composition (vol. %) | | | | | | |
| $H_2$ | 11.6 | 16.1 | 10.2 | 9.8 | 10.6 | 10.6 |
| CO | 3.9 | 2.9 | 3.7 | 4.5 | 3.9 | 3.9 |
| $CO_2$ | 5.4 | 9.2 | 6.1 | 7.9 | 7.6 | 5.5 |
| $C_1$–$C_8$ | 75.4 | 71.7 | 76.6 | 75.6 | 74.0 | 76.6 |
| $H_2S$ | 3.7 | 0.1 | 3.3 | 2.3 | 3.8 | 3.4 |
| $CH_4$ | 49.8 | 45.9 | 48.9 | 47.9 | 47.7 | 48.9 |
| $C_2H_4$ | 1.3 | 1.5 | 1.4 | 1.5 | — | 1.4 |
| $C_2H_6$ | 11.2 | 10.3 | 11.3 | 11.1 | 11.2 | 11.8 |

While dolomite or dolomite calcined at 700° C. for 2.5 hours did not show sufficient activity in improving product quality, calcined hydrated dolomite at a low concentration of about 5 to 10 wt. % (Ca/S ratios of 0.6 or 1.2) showed significant catalytic activity. The influence of added calcined hydrated dolomite on pyrolysis product quality and yield is shown in Table IV. The results demonstrate that while 5 wt. % hydrated dolomite reduced $H_2S$ from 3.7 to 0.25 percent, 10 wt. % percent reduced $H_2S$ yield to 0.1 percent of total gas. Other benefits of this additive are reflected in the reduced sulfur content of tar and significant decrease of $CO_2$ in the gas phase products. In addition there was a reduction in viscosity and Conradson carbon residue of the liquid products when co-pyrolyzed with the dolomite material. It is expected that clacined calcium hydroxide will also provide sufficient activity in improving product quality so as to useful in the practice of the present invention.

TABLE IV

Influence of Added Calcined Hydrated Dolomite on Pyrolysis Products for Pittsburgh No. 8 Coal at 500° C.

| | Pittsburgh No. 8 Coal 500° C. | Pittsburgh No. 8 Coal with 5 wt. % | Pittsburgh No. 8 Coal with 10 wt. % |
|---|---|---|---|
| Total Gas | 7.0 | 6.8 | 6.7 |
| Char Alone (wt. %) | 75.3 | 76.1 | 75.2 |
| Tar (wt. %) | 17.7 | 17.2 | 17.4 |
| Water (wt. %) | 1.6 | 3.4 | 4.0 |
| Gas Composition (Vol. %) | | | |
| $H_2$ | 11.6 | 9.33 | 11.5 |
| CO | 3.9 | 3.73 | 3.26 |
| $CO_2$ | 5.4 | 0.56 | 0.16 |
| $H_2S$ | 3.7 | 0.256 | 0.105 |
| COS | 0.39 | 0.036 | 0.016 |
| $H_2O$ | 0.25 | 0.51 | 0.388 |
| $CH_4$ | 49.8 | 54.74 | 53.17 |
| $C_2H_4$ | 1.33 | 1.17 | 1.72 |
| $C_2H_6$ | 11.2 | 13.37 | 12.95 |
| $C_1$–$C_8$ | 75.4 | 85.55 | 84.57 |
| Tar Composition (Wt. %) | | | |
| Ash | 0.03 | <.01 | <.01 |
| C | 80.7 | 81.18 | 82.4 |
| H | 9.1 | 8.98 | 9.03 |
| S | 0.72 | 0.62 | 0.60 |

The principles of pyrolysis of coal with CAO application is readily extendable to the pyrolysis of oil shale. A Colorado oil shale (Mahogany Zone) was pyrolyzed with 20 wt. % CaO. The results shown in Table V below indicate that there was a significant reduction in $H_2S$ in the gas products while the sulfur content of the oil was reduced by about 40%. The hot combusted shale can be recycled back to the shale retort to recover sensible heat and any significant calcium oxide in the combusted shale will improve the quality of the recovered products.

TABLE V

Influence of Added CaO on Shale Retort Products for Colorado Oil Shale (Mahogany Zone) at 500 ° C.

| | Colorado Shale 200 g | Colorado Shale 200 g + 40 gm CaO |
|---|---|---|
| Total Gas (l) | 7.2 | 6.5 |
| Oil (wt. %) | 12.2 | 12.0 |
| Water (wt. %) | 2.0 | 2.8 |
| Gas Composition (Vol. %) | | |
| $H_2$ | 21.13 | 35.17 |
| CO | 3.27 | 2.35 |
| $CO_2$ | 22.03 | 0.045 |
| $H_2S$ | 5.74 | 0 |
| COS | 0.33 | 0 |
| $H_2O$ | .336 | 0.43 |
| $CH_4$ | 21.77 | 27.38 |
| $C_2H_4$ | 1.79 | 2.08 |
| $C_2H_6$ | 7.12 | 7.92 |
| $C_1$–$C_8$ | 47.15 | 62.01 |
| Tar Composition (Wt. %) | | |
| Ash | .01 | .02 |
| C | 83.4 | 83.2 |
| H | 10.7 | 11.01 |

TABLE V-continued

Influence of Added CaO on Shale Retort Products for Colorado Oil Shale (Mahogany Zone) at 500 ° C.

| | Colorado Shale 200 g | Colorado Shale 200 g + 40 gm CaO |
|---|---|---|
| S | 1.05 | 0.60 |
| N | 2.60 | 2.57 |
| O | 3.25 | 2.58 |
| H/C (Atomic) | 1.56 | 1.587 |
| Btu/lb) | 18,118.0 | 18,219.0 |
| Viscosity in cST at 100° F. | 8.25 | 5.5 |
| Conradson Carbon Residue | 1.09 | 0.68 |
| Density (gm/cc) | 0.91 | 0.9089 |
| API (at 60° F.) | 23.9 | 24.1 |

It will be seen that the pyrolysis method of the present invention provides a significant advancement in the art in that the pyrolysis of the coal or oil shale at relatively low temperatures in the presence of certain calcium compounds provides for considerably enriched product liquid and gases. These liquids and gases so produced have environmentally safe properties due to the very low sulfur content and reduced oxygen content as compared to product gases and liquids heretofore provided by known pyrolysis techniques in which products required upgrading to meet environmental standards.

I claim:

1. A gasification method for the production of liquid and gaseous products from carbonaceous materials, consisting of the steps of heating at a rate in the range of about 5° to 50° C. per minute a particulate mixture consisting essentially of carbonaceous material selected from coal or oil shale in an average particle size range of about 8 to 100 mesh and about 5 to 25 wt. % of a calcium compound of an average particle size of less than about 325 mesh to a pryolysis temperature in the range of about 450° to 700° C., maintaining the mixture at a temperature within said range for a duration of about 10 to 60 minutes, and removing liquid and gaseous products generated during the pyrolysis of the carbonaceous material.

2. The gasification method claimed in claim 1 wherein the calcium compound is calcium oxide or calcined and hydrated dolomite.

3. The coal gasification method claimed in claim 2 wherein the pyrolysis temperature is about 500° C., and wherein said mixture is maintained at a temperature of at least about 500° C. for said duration.

4. The coal gasification method claimed in claim 3 wherein the concentration of calcium oxide in said coal-calcium compound mixture is about 5 to 21 wt. %.

* * * * *